US005791382A

United States Patent [19]

Froment et al.

[11] Patent Number: 5,791,382

[45] Date of Patent: Aug. 11, 1998

[54] SEPARABLE COLLAR FOR THE HARNESS OF A JACQUARD MECHANISM

[75] Inventors: Jean-Paul Froment, Doussard; Jean-Jacques Lacroix, Lovagny, both of France

[73] Assignee: Staubli Faverges, Faverges, France

[21] Appl. No.: 817,296

[22] PCT Filed: Oct. 23, 1995

[86] PCT No.: PCT/FR95/01399

§ 371 Date: Apr. 15, 1997

§ 102(e) Date: Apr. 15, 1997

[87] PCT Pub. No.: WO96/12836

PCT Pub. Date: May 2, 1996

[30] Foreign Application Priority Data

Oct. 24, 1994 [FR] France ..... 94 12922

[51] Int. Cl.[6] ..... D03C 3/40

[52] U.S. Cl. ..... 139/85; 403/329; 24/616

[58] Field of Search ..... 403/329; 24/616; 139/59, 85

[56] References Cited

U.S. PATENT DOCUMENTS 5,636,663 6/1997 Lacroix ..... 139/85

5,671,782 9/1997 Lemaire et al. ..... 139/85

FOREIGN PATENT DOCUMENTS 0197331 3/1986 European Pat. Off. .

0546967 12/1992 European Pat. Off. .

1426704 3/1965 France .

2300154 2/1976 France .

4213958 4/1993 Germany .

*Primary Examiner*—Andy Falik

*Attorney, Agent, or Firm*—Dowell & Dowell, P.C.

[57] ABSTRACT

A collar for selectively connecting and disconnecting twines and harness cords in a jacquard harness mechansim for a weaving loom. The collar includes a socket element having at least one elastically deformable chuck with jaws for engaging a prong of a male element inserted within the socket element. The male element includes a shuttle which is moveable along a rod which extends from the prong to an intermediate portion of the male element which aligns the male element with the socket element. The shuttle separates the jaws of the at least one elastically deformable chuck during relative axial movement of the male element with respect to the socket element to permit the prong of the male element to be inserted into or withdrawn from engagement with the socket element.

22 Claims, 4 Drawing Sheets

SEPARABLE COLLAR FOR THE HARNESS OF A JACQUARD MECHANISM

BACKGROUND OF THE INVENTION

1. Field of the Invention

The present invention relates to the Jacquard mechanisms for the milling on looms and it relates, in particular, to the harnesses that are attached to the moveable operating elements of these mechanisms for the control of the warp yarn.

2. History of the Related Art

It is known that a harness of typical construction comprises a multitude of twines, the number of which is equal to that of the mechanism's operating elements; each of these twines is tied in with one or several harness cords which, in turn, are fastened to the eyeletted heddles. The fastening of these twines and of the harness cords is by means of snaps, of very poor control, and it can be seen that the disassembling and the subsequent reassembling of a harness be it for repairs or its replacement, implies the handling of several thousands of snaps. Therefore, the operation is lengthy and tedious, thus causing a costly interruption of production.

Consequently, the chief object of the present invention is to remedy this inconvenience, to wit, by using a collar joint that is designed in a such manner so as to render a simple and quick operation, requiring that only one piece be moved in an axial direction.

In a technical field other than that of the invention, Patent EP 197,331 discloses, for example, jewelry clasps having a pointed end and a shuttle, that are used under very different conditions than those of looms.

SUMMARY OF THE INVENTION

The collar joint in accordance with the invention comprises two elements, male and female, that are affixed, respectively, to the extremities of the twine and of the harness cord to be fastened, in such a manner that one of these elements can axially fit into the other. The female element comprises at least one chuck whose jaws are shaped so that they grip the male element directly behind a prong provided at the end of the male element. Behind the prong, the male element is provided with an axially moveable sleeve or shuttle in order to ensure the operation of the jaws when they are opening or closing. The bearing area of the jaws against the back of the prong is essentially parallel to the back of the prong when the chuck is in a closed position.

According to an advantageous embodiment of the invention, the bearing area of the chuck against the back of the prong is essentially radial when the chuck is in a closed position. Thus, the vibrations due to the movements of the loom and of the surroundings that constantly act upon the jaws cause them to be flexing, which is suitable to their geometry. Therefore, there is no risk of wear and tear or of a breaking of the jaws because such a risk would exist in the case of a collar in which the jaws would rest on a ridge or on their edges against the back of the prong. The jaws would thus be acted upon by creep and their pin shaped extremities would be worn out by multiple contacts with the prong.

In an another advantageous embodiment of the invention, the bearing area of each jaw against the shuttle is essentially axial when the chuck is in an open position. This causes the stresses transmitted by the chuck to the shuttle to be radial, that is to say, perpendicular to the shuttle with respect to the rest of the male element. Thus, the shuttle does not tend to be displaced by the axial stresses imparted by the jaws and, in particular, there is not risk that these stresses move it to the opposite side of the prong.

Consequently, the axial length of the shuttle is greater than the distance between the external surface of the jaws and the back of the prong when the male element is completely inserted into the female element. The shuttle does not to slip from the jaws when being pushed back between the jaws and the prong. This features makes it possible to prevent the risks of a jamming of the shuttle.

BRIEF DESCRIPTION OF THE DRAWINGS

The invention will be better understood and some of its other advantages will be more clearly elucidated in light of the below description of an embodiment of a removable collar for the fastening of twines and cords of a harness of a Jacquard mechanism, given solely by way of example and referenced in the hereto attached drawings wherein.

DESCRIPTION OF THE PREFERRED EMBODIMENTS

Figure 1:
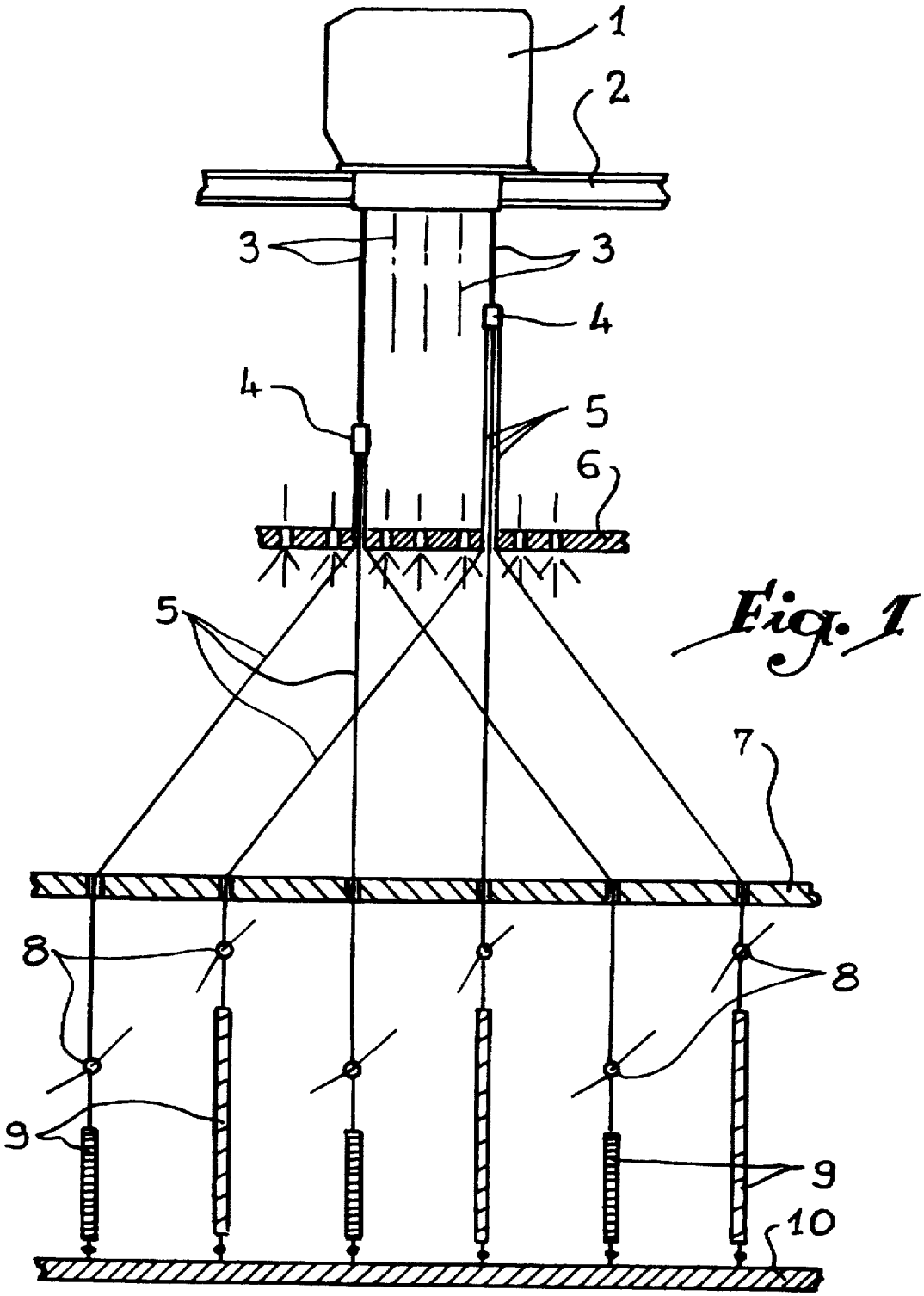
FIG. 1 shows in a schematic form the general disposition of a harness of a jacques mechanism.

In FIG. 1, reference number 1 designates a weaving mechanism of VERDOL or Jacquard type held above the loom by a structure 2. Each of the usual twines 3 of the mechanism 1 is fastened by means of a removable collar 4 to one or several harness cords 5 that transverse a board with holes 6, underneath of which each twine passes through a cording board 7 and is provided with a reed eyelet 8 prior to be attached to a return spring 9 that is affixed to a base plate 10, located underneath the (not shown) loom.

Each collar 4 is constituted by two components, namely, one female element or socket 11 integral with one or several harness cords 5 and one male element or ferrule 12, the lower part of which interacts with the element 11.

As shown, the female element 11 is constituted by a tubular, cylindrical element, open at its top, that is obtained by casting a semi-rigid plastic material susceptible to elastic deformation. Underneath its opening at the top, this element 11 has longitudinally punched-out slots that define two chucks 13 opposed to each other, one being independent of the other, the lower extremity of which is curved to form a slightly concave 13*a*.

The male element 12 is constituted by a cylindrical piece of a rigid plastic material, having a logitudinal axis A—A whose lower extremity is shaped to form a prong 12*a*. On the cylindrical rod 12*b* of lesser diameter that rises above this prong 12*a*, slides freely a shuttle 14 constituted by a split ring which, through momentary elastic deformation, is susceptible to be engaged on the rod 12*b*, between the back on outwardly extending flange 12*e* and prong 12*a* and the ring-shaped shoulder 12*c* of an intermediate cylindrical portion 12*f* of the male element 12. Its upper portion 12*g* is axially deepened in order to take up and hold the extremity of one of the twines 3 of the mechanism; likewise, the bottom portion 11*a* of the female element 11 of the collar is fashioned in such a manner as to receive and hold the extremity of one or of several harness cords 5.

Figure 3:
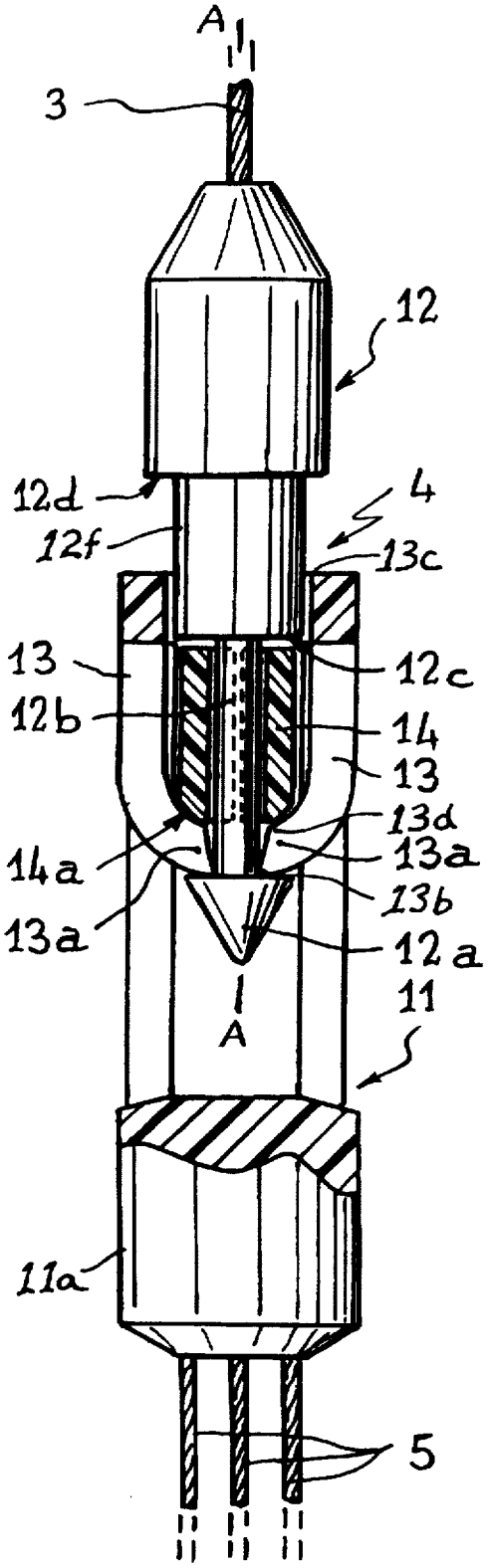
FIGS. 3 to 6 show axial sections at an enlarged scale, illustrating the successive steps of the collar's operating process.

When the mechanism 1 is in an operating mode, each of the collars 4 according to the invention is in the coupled position as illustrated in FIG. 3. The prong 12*a* is engaged in the female element 11 and it is positioned in such an axial position that the lower jaws 13*a* are located immediately above the prong, so that the prong is held in place preventing any separation of the elements 11 and 12. Thus, the chucks 13 are in a closed position.

Due to that the jaws 13*a* are constituted by the curved extremity of the chucks 13, the bearing area 13*b* of the jaws against the back or flange 12*e* of the prong 12*a* is essentially radial. Each chuck 13 functions thus in a flexible manner when the prong tends to shift, which is compatible with the mechanical properties of the semi-rigid plastic material utilized in the manufacture of the chucks 13. This is particularly advantageous with respect to a mechanism in which the chucks would rest on their edges against the back of the prong because then the jaws would thus be subjected to creep caused by the vibrations of the loom and of the surroundings, as well as by the weight of the harness, which could bring about that they break or warp in the direction of the shuttle which would risk a blocking of the shuttle in its position.

Moreover, the fact that the bearing area of the jaws 13*a* at the back of the prong 12*a* is essentially radial prevents that a pointed cant or the edge of the jaws 13*a* would not rest against the prong 12*a*, which could bring about an early wear and tear caused by the previously mentioned vibrations and load. Thus, the disposition of the jaws 13*a* with respect to the prong 12*a* allows the withstanding of the considerable mechanical stresses imparted upon the collar.

It must be well understood that, if the back or flange 12*e* of the prong 12*a* is not perpendicular to the its axis of movement, but presents a positive angle with respect to the horizontal so that the prong is shaped like an arrow, the external bearing area of the jaws 13*a* can be adjusted so that, when the mechanism is in the position illustrated in FIG. 3, the external area of the jaws 13*a* and the back of the prong rest against each other in an essentially parallel manner.

Whenever the collar 4 is to be disassembled, the operator exercises upon the elements 11 and 12 an axial contraction stress in order to bring them closer together. With this axial movement, the jaws 13*a* of the chucks 13 slide along the cylindrical rod 12*b* causing a very slight raising of the shuttle 14.

Figure 4:
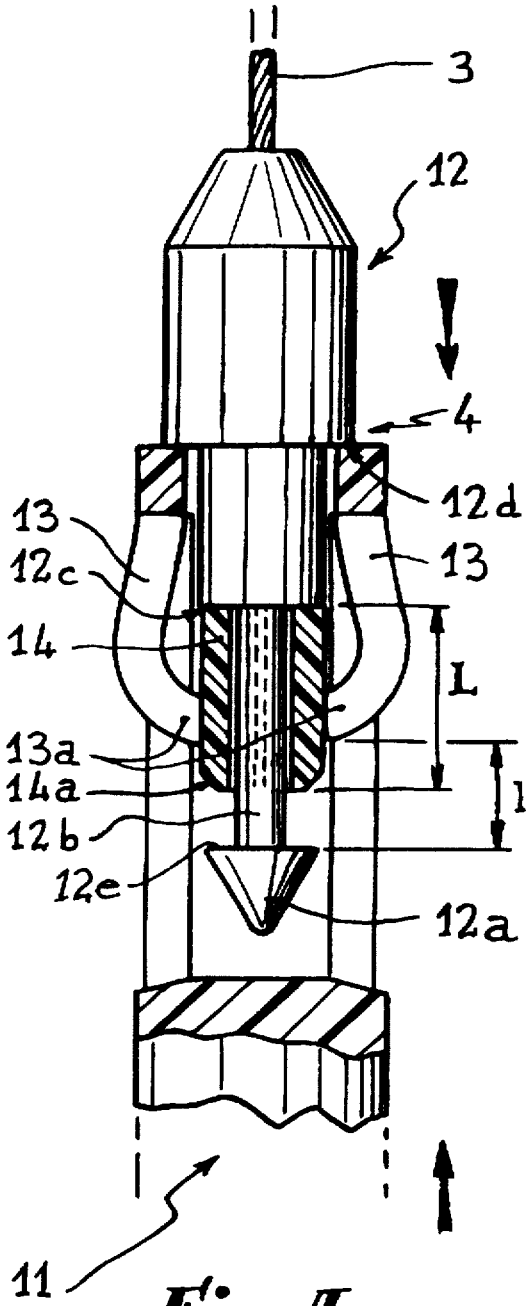

Continuing the axial movement of bringing together, at a given moment, the shuttle 14 reaches its upward end of travel against the ring-shaped shoulder 12*c*, such as shown in FIG. 4, so that the jaws 13*a*, after having been caused to open by means of a chamfered edge 14*a* provided at the lower edge of the shuttle, then grip whatever is axially integral with the chucks 13 and the female element 11, being the chucks in their open position.

The chamfered edge 14*a* contributes to facilitate that the shuttle 14 opens the jaws 13*a* and it can be observed that through the combination of the curved jaws 13*a* and the chamfered edge 14*a* there can be obtained a considerable radial movement of the jaws by means of a slight axial movement and, consequently, a good dimensioning of the span, having regard however for a minimum overall space, which constitutes a main consideration in a Jacquard harness taking into consideration the large number of components that must not interfere with each other while occupying the most reduced total area.

Further, in the closed position of the chucks 13, the jaws 13*d* of the jaws 13*a* taper outwardly with respect to the cylindrical rod 12*b* in a direction relative to the chamfered edge 14*a*, which contributes to the opening of the chucks 13 because the engagement of the chamfered edge 14*a* between the chucks 13 is facilitated.

Figure 5:
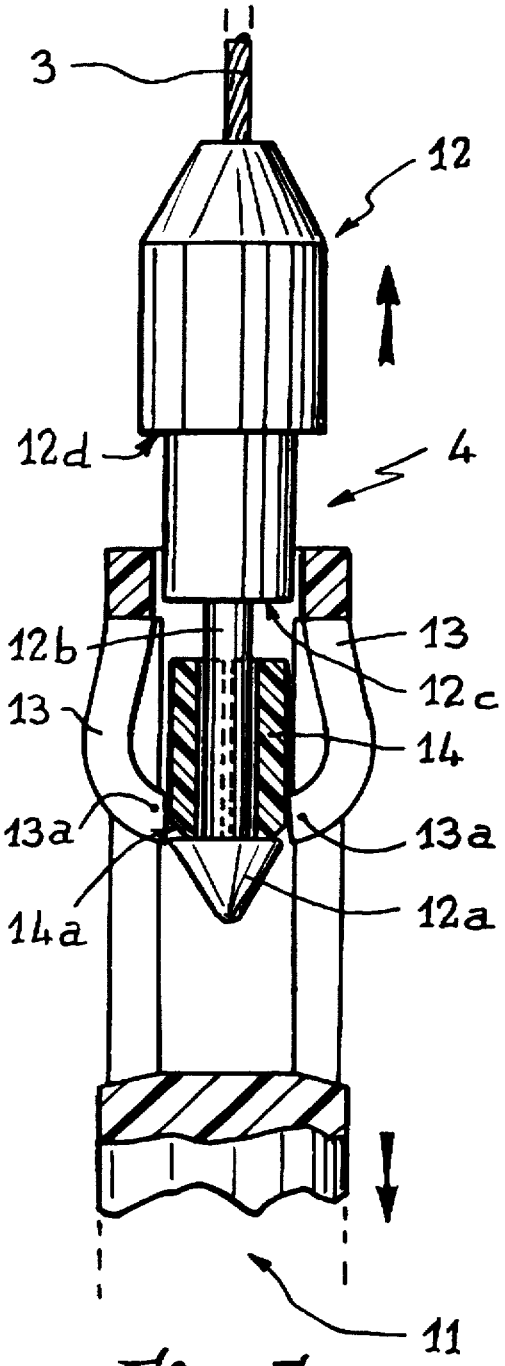

In the open position of the chucks 13, such as shown in FIGS. 4 and 5, the bearing area of the jaws 13*a* against the cylindrical rod 12*b* of the male element 12 is essentially axial. The gripping stresses due to the semi-rigid nature of the chucks 13 are essentially radial, which indicates that the shuttle 14 does not tend to move in the axial direction along the cylindrical rod 12*b*. The shuttle 14 is thus closely held in position by the jaws 13*a* and is not driven by axial stresses in direction to the shoulder 12*c*.

Furthermore, in order to prevent that the shuttle 14 could become wedged between the jaws 13*a* and the back or flange of the prong 12*a*, the shuttle's length L is greater than the distance 1 between the external area of the jaws 13*a* and the back of the prong 12*a*, when an upper shoulder 12*d* of the element 12 rests against the upper portion of the female element 11, as illustrated in FIG. 4.

When the upper edge of the female element 11 abuts against the second ring-shaped shoulder 12*d* rising above the first 12*c*, the operator reverses his axial pull and tends to separate the elements 11 and 12 from each other, so that the shuttle 14, still gripped by the jaws 13*a*, moves downward along the cylindrical portion 12*b*. At a given point of the separation movement, the shuttle 14 comes to a standstill against the upper area of the prong 12*a*, such as shown in FIG. 5, which allows the jaws 13*a* to release the grip at the widest diameter portion of the prong 12*a* because of the fact that the height of said jaws is greater than the height of the chamfered edge 14*a* of the shuttle.

Such as shown in FIGS. 3 to 6, the radial play between the cylindrical intermediate portion 12*f* of the male element 12 positioned between the two shoulders 12*c* and 12*d* and the ring-shaped opening 13*c* of the female element 11 is rather slight in order that the span between this cylindrical portion and the opening serve as axial guide for the male element 12 in the female element 11. This axial guide allows, first and foremost, the maintaining of a good alignment of the parts during the dynamic operation of the mechanism, thus ensuring of optimal geometries at the supports of the jaws and preventing an early wear and tear of the components. Furthermore, the same axial guide prevents, at the time of its movements, that the shuttle 14 be poorly aligned with the axis of the female element 11 with respect to the jaws 13*a*, whereas any defective alignment is susceptible to result in a wedging of the shuttle 14 and thus a blocking of the collar.

Figure 2:
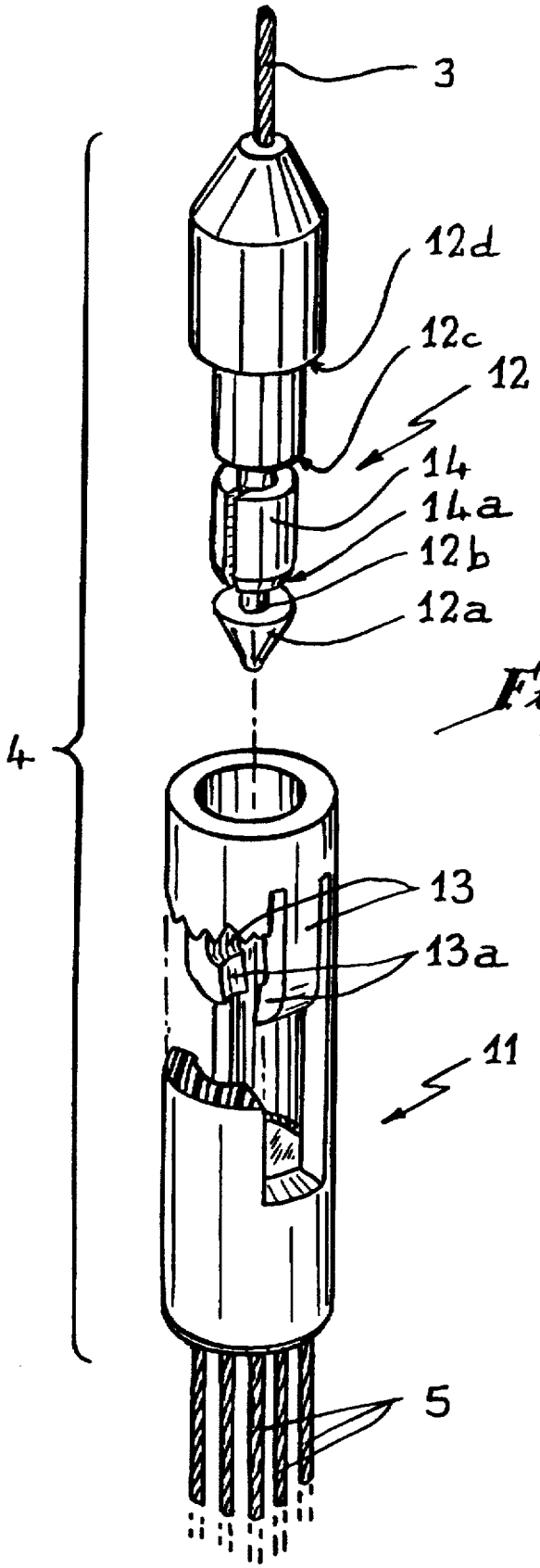
FIG. 2 shows in a cutaway perspective view the two elements constituting a collar according to the invention.

The continued movement to separate the two elements 11 and 12 causes their separation in the manner as illustrated in FIG. 2.

Figure 6:
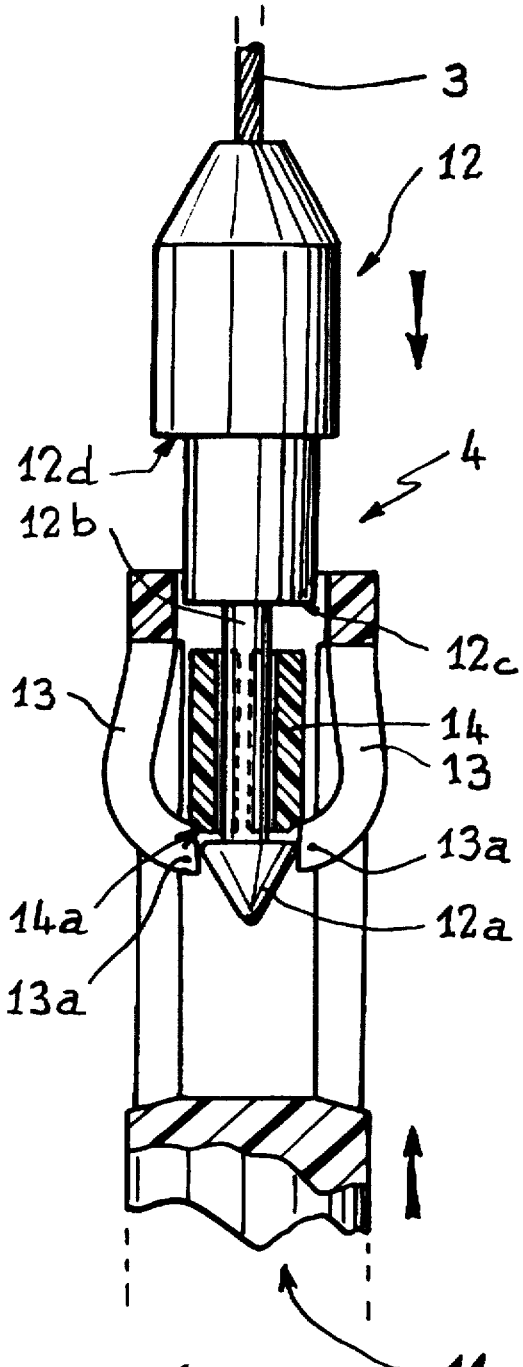

Thus, the uncoupling of these two elements from the collar does finally bring about an axial movement in the two opposite directions. It is about the same in the case of a coupling because the axial engagement of the two elements of the collar causes, first and foremost, the separation of the jaws 13*a* at the level of the prong 12*a* of the extremity and then the raising of the shuttle 14, such as shown in FIG. 6; the jaws will finally lock around it above the prong 12*a*, as illustrated in FIG. 3.

It is understood that the grip by the female element 11 of the collars may comprise only one or more than two chucks. It can be noted that, in all instances, the operation of the collar both for the coupling as well as for the separation is simplified when compared with that of the customary snaps; such a simplification allows an automatization for the simultaneous handling of all the collars 4 of the mechanism.

It must be further understood that the foregoing description was given only by way of example and that it does not limit at all the scope of the invention that would be respected ever if the described details of manufacture would be replaced by any others of similar nature. In particular, the shuttle 14 can be given a wide-base truncated shape turned to the side of the prong 12*a* so that, during the uncoupling operation, the gripping by the jaws of the shuttle brings the latter into the direction of the prong.

What is claimed is:

1. A jacquard apparatus for a weaving loom including twines and harness cords, the improvement comprising a separable collar for fastening said twines and harness cords, the separable collar comprising:

a socket element having an open end and having at least one elastically deformable chuck with an extremity defined by spaced jaws, a male element having an outer prong which defines a flange extending radially outwardly from a rod which extends between said prong and an outwardly extending shoulder of said male element, a shuttle moveable along said rod and including a forward end adjacent said prong and a rear end selectively engageable with said shoulder and an outer surface, and said male element being axially moveable relative to said socket from a first locked position wherein said spaced jaws of said at least one elastically deformable chuck are engageable between said flange of said prong and said shuttle to a second unlocked position wherein said spaced jaws engage said outer surface of said shuttle between said forward and rear ends thereof such that said jaws are spaced apart a distance sufficient to permit said flange of said prong to pass therebetween to thereby separate said male element from said socket when said flange of said prong is engaged with said forward end of said shuttle, and each of said spaced jaws including an outer bearing surface which is engageable with said flange of said prong in said first locked position with said bearing surfaces being substantially parallel to said flange when in engagement therewith.

2. The separable collar for a jacquard mechanism of claim 1 wherein said bearing surfaces of said spaced jaws extend generally radially outwardly perpendicularly with respect to a longitudinal axis of said male element.

3. The separable collar for a jacquard mechanism of claim 2 wherein each of said spaced jaws includes a face which engages said outer surface of said shuttle in said second position with said faces extending generally parallel to said longitudinal axis of said male element.

4. The separable collar for a jacquard mechanism of claim 3 wherein said socket element includes an outer wall, said at least one elastically deformable chuck being integrally formed with said outer wall of said socket element and extending from adjacent said open end thereof toward an opposite end of said socket element, and said jaws being curved so as to extend inwardly of said socket element toward said longitudinal axis of said male element.

5. The separable collar for a jacquard mechanism of claim 4 wherein said male element includes an intermediate portion from which said rod extends to said prong, said intermediate portion being of a size to be guidingly received within said open end of said socket element, whereby said open end of said socket element cooperatively guides said male element in axially moveable relationship therewith.

6. The separable collar for a jacquard mechanism of claim 5 in which said forward end of said shuttle includes a chamfered edge which tapers inwardly toward said rod in the direction of said prong, said chamfered edge being engageable to separate said spaced jaws when said shuttle is moved axially with respect to said spaced jaws in a direction inwardly relative to said socket element.

7. The separable collar for a jacquard mechanism of claim 3 wherein said socket element includes an outer wall, said at least one elastically deformable chuck being integrally formed with said outer wall of said socket element and extending from adjacent said open end thereof toward an opposite end of said socket element, and said jaws being curved so as to extend inwardly of said socket element toward said longitudinal axis of said male element.

8. The separable collar for a jacquard mechanism of claim 1 wherein said shuttle has an axial length which is greater than a distance between said bearing surfaces of said spaced jaws and said flange of said prong when said prong is at an innermost position within said socket element.

9. The separable collar for a jacquard mechanism of claim 1 wherein said male element includes an intermediate portion from which said rod extends to said prong, said intermediate portion being of a size to be guidingly received within said open end of said socket element, whereby said open end of said socket element cooperatively guides said male element in axially moveable relationship therewith.

10. The separable collar for a jacquard mechanism of claim 1 in which said forward end of said shuttle includes a chamfered edge which tapers inwardly toward said rod in the direction of said prong, said chamfered edge being engageable to separate said spaced jaws when said shuttle is moved axially with respect to said spaced jaws in a direction inwardly relative to said socket element.

11. The separable collar for a jacquard mechanism of claim 10 in which said faces of said jaws have a height which is greater than a height dimension of said chamfered edge of said shuttle whereby said spaced jaws are forced and retained outwardly by said shuttle a sufficient distance to allow said flange of said prong to pass therebetween when said male element is moved from said first position to said second position.

12. The separable collar for a jacquard mechanism of claim 11 wherein said faces of said jaws taper outwardly relative to one another and toward said shuttle when said jaws are in said first position to thereby further facilitate the opening of said jaws by the chamfered edge of said shuttle.

13. The separable collar for a jacquard mechanism of claim 1 in which said shuttle is formed of an elastically yieldable material having a longitudinal slit therein which facilitates the mounting of said shuttle about said rod.

14. A jacquard apparatus for a weaving loom including twines and harness cords, the improvement comprising a separable collar for fastening said twines and harness cords, the separable collar comprising:

a socket element having an open end and having at least one elastically deformable chuck with an extremity defined by spaced jaws, a male element having an outer prong which defines a flange extending radially outwardly from a rod which extends between said prong and an outwardly extending shoulder of said male element, a shuttle moveable along said rod and including a forward end adjacent said prong and a rear end selectively engageable with said shoulder and an outer surface, and said male element being axially moveable relative to said socket from a first locked position wherein said spaced jaws of said at least one elastically deformable chuck are engageable between said flange of said prong and said shuttle to a second unlocked position wherein said spaced jaws engage said outer surface of said shuttle between said forward and rear ends thereof such that said jaws are spaced apart a distance sufficient to permit said flange of said prong to pass therebetween to thereby separate said male element from said socket when said flange of said prong is engaged with said forward end of said shuttle, each of said spaced jaws being engageable with said flange of said prong in said first locked position, and said shuttle having an axial length which is greater than a distance between said spaced jaws and said flange of said prong when said prong is at an innermost position within said socket element.

15. The separable collar for a jacquard mechanism of claim 14 in which said shuttle is formed of an elastically yieldable material having a longitudinal slit therein which facilitates the mounting of said shuttle about said rod.

16. The separable collar for a jacquard mechanism of claim 15 wherein each of said spaced jaws includes an outer bearing surface which is engageable with said flange of said prong in said first locked position with said bearing surfaces being substantially parallel to said flange when in engagement therewith.

17. A jacquard apparatus for a weaving loom including twines and harness cords, the improvement comprising a separable collar for fastening said twines and harness cords, the separable collar comprising:

a socket element having an open end and having at least one elastically deformable chuck with an extremity defined by spaced jaws, a male element having an outer prong which defines a flange extending radially outwardly from a rod which extends between said prong and an outwardly extending shoulder of said male element, a shuttle moveable along said rod and including a forward end adjacent said prong and a rear end selectively engageable with said shoulder and an outer surface, and said male element being axially moveable relative to said socket from a first locked position wherein said spaced jaws of said at least one elastically deformable chuck are engageable between said flange of said prong and said shuttle to a second unlocked position wherein said spaced jaws engage said outer surface of said shuttle between said forward and rear ends thereof such that said jaws are spaced apart a distance sufficient to permit said flange of said prong to pass therebetween to thereby separate said male element from said socket when said flange of said prong is engaged with said forward end of said shuttle, said forward end of said shuttle including a chamfered edge which tapers inwardly toward said rod in the direction of said prong, said chamfered edge being engageable to separate said spaced jaws when said shuttle is moved axially with respect to said spaced jaws in a direction inwardly relative to said socket element, and said faces of said spaced jaws having a height which is greater than a height dimension of said chamfered edge of said shuttle whereby said spaced jaws are forced and retained outwardly by said shuttle a sufficient distance to allow said flange of said prong to pass therebetween when said male element is moved from said first position to said second position.

18. The separable collar for a jacquard mechanism of claim 17 wherein said faces of said jaws taper outwardly relative to one another and toward said shuttle when said jaws are in said first position to thereby further facilitate the opening of said jaws by the chamfered edge of said shuttle.

19. The separable collar for a jacquard mechanism of claim 17 wherein said socket element includes an outer wall, said at least one elastically deformable chuck being integrally formed with said outer wall of said socket element and extending from adjacent said open end thereof toward an opposite end of said socket element, and said jaws being curved so as to extend inwardly of said socket element toward said longitudinal axis of said male element.

20. The separable collar for a jacquard mechanism of claim 17 wherein said shuttle has an axial length which is greater than a distance between said bearing surfaces of said spaced jaws and said flange of said prong when said prong is at an innermost position within said socket element.

21. The separable collar for a jacquard mechanism of claim 17 wherein said male element includes an intermediate portion from which said rod extends to said prong, said intermediate portion being of a size to be guidingly received within said open end of said socket element, whereby said open end of said socket element cooperatively guides said male element in axially moveable relationship therewith.

22. The separable collar for a jacquard mechanism of claim 17 wherein each of said spaced jaws includes an outer bearing surface which is engageable with said flange of said prong in said first locked position with said bearing surfaces being substantially parallel to said flange when in engagement therewith.

* * * * *